US007649324B2

(12) United States Patent
Ilyes et al.

(10) Patent No.: US 7,649,324 B2
(45) Date of Patent: Jan. 19, 2010

(54) AUXILIARY LIGHTING CIRCUIT FOR HIGH INTENSITY DISCHARGE SYSTEM

(75) Inventors: Laszlo S. Ilyes, Richmond Heights, OH (US); Louis R. Nerone, Brecksville, OH (US); Melvin C. Cosby, Jr., Grand River, OH (US)

(73) Assignee: General Electric Company, Schenectady, NY (US)

( * ) Notice: Subject to any disclaimer, the term of this patent is extended or adjusted under 35 U.S.C. 154(b) by 325 days.

(21) Appl. No.: 11/845,889

(22) Filed: Aug. 28, 2007

(65) Prior Publication Data

US 2008/0042598 A1 Feb. 21, 2008

Related U.S. Application Data

(62) Division of application No. 11/182,159, filed on Jul. 15, 2005, now Pat. No. 7,276,855.

(51) Int. Cl.
*H05B 37/00* (2006.01)

(52) U.S. Cl. ..... 315/209 R; 315/224; 315/307

(58) Field of Classification Search ..... 315/224, 315/209 R, 291, 307, 308, DIG. 5, DIG. 7
See application file for complete search history.

(56) References Cited

U.S. PATENT DOCUMENTS

| | | | | |
|---|---|---|---|---|
| 6,489,729 | B1 | 12/2002 | Erhardt et al. | |
| 6,879,113 | B2 * | 4/2005 | Nemirow | 315/209 R |
| 7,019,468 | B2 | 3/2006 | Deurloo et al. | |
| 7,109,659 | B2 | 9/2006 | Kamoi | |
| 7,312,586 | B2 * | 12/2007 | Montante | 315/291 |
| 2003/0160573 | A1 | 8/2003 | Johnson | |

* cited by examiner

*Primary Examiner*—David Hung Vu
(74) *Attorney, Agent, or Firm*—Fay Sharpe LLP

(57) ABSTRACT

The embodiment disclosed herein relates to a lighting system that includes an auxiliary lighting circuit for use with an electronic HID ballast. The lighting system comprises a power supply configured to provide power to a high intensity discharge (HID) lamp via an electronic ballast and a ballast power sensing component configured to determine the amount of power drawn by the electronic ballast and to convert this power drawn by the electronic ballast to a scaled voltage that is representative of the power drawn by an HID ballast. A lamp driver component is configured to provide power to an auxiliary lamp via the same power supply when the scaled voltage reaches a triggering threshold. A voltage regulation component is configured to regulate the power delivered to the auxiliary lamp such that the auxiliary lamp power stays within a predefined range.

8 Claims, 5 Drawing Sheets

AUXILIARY LIGHTING CIRCUIT FOR HIGH INTENSITY DISCHARGE SYSTEM

This is a divisional application of U.S. application Ser. No. 11/182,159, filed on Jul. 15, 2005, now U.S. Pat. No. 7,276,855 the disclosure of which is incorporated herein by reference.

BACKGROUND

Generally, when a high intensity discharge (HID) lamp is extinguished (e.g., during a significant power interruption), the lamp typically cannot be re-lit for a considerable period of time after the main power supply voltage is restored. For ceramic metal halide lamps, this time may be up to forty minutes. In order to provide light in the interim, traditional HID lamp/ballast systems are equipped with an auxiliary lighting system to drive a quartz halogen lamp (e.g., 120V) from a tapped ballast winding. There are numerous existing patents related to this type of implementation, one which employs electronic implementation is Erhardt, et al. (U.S. Pat. No. 6,489,729 B1). This patent provides a general conceptual discussion related to auxiliary lighting solutions, however this patent does not disclose a circuit for implementing the auxiliary lighting system.

When utilizing such auxiliary lighting systems, it is desirable for the auxiliary light to turn off at a consistent HID lamp power level, despite the line voltage. Conventional circuits consider the HID ballast current level in determining when the auxiliary lamp should be deactivated. Since the prevailing line voltage substantially affects the amount of current drawn by the power regulating an HID ballast, the auxiliary lamp generally turns off sooner in customer applications using lower line voltages (e.g., 208V) as compared to otherwise similar customer applications using higher line voltages (e.g., 277V). Thus, it is desirable to for the voltage applied to the auxiliary lamp to remain consistent, even in the presence of transient line voltage disturbances caused by other industrial equipment operating from the same circuit.

What is needed is an auxiliary lighting system that reliably operates when required and that provides a consistent power supply to maintain lighting when the main lighting source is disabled.

SUMMARY

The embodiment disclosed herein relates to a lighting system that includes an auxiliary lighting circuit for use with an electronic HID ballast. The lighting system comprises a power supply configured to provide power to a high intensity discharge (HID) lamp via an electronic ballast and a ballast power sensing component configured to determine the amount of power drawn by the electronic ballast and to convert the determined power drawn by the electronic ballast to a scaled voltage that is representative of the ballast input power. A lamp driver component is configured to provide power to an auxiliary lamp via the same power supply when the scaled line voltage reaches a triggering threshold. A voltage regulation component is configured to regulate the power delivered to the auxiliary lamp such that the auxiliary lamp power stays within a predefined range.

DETAILED DESCRIPTION

Figure 1:
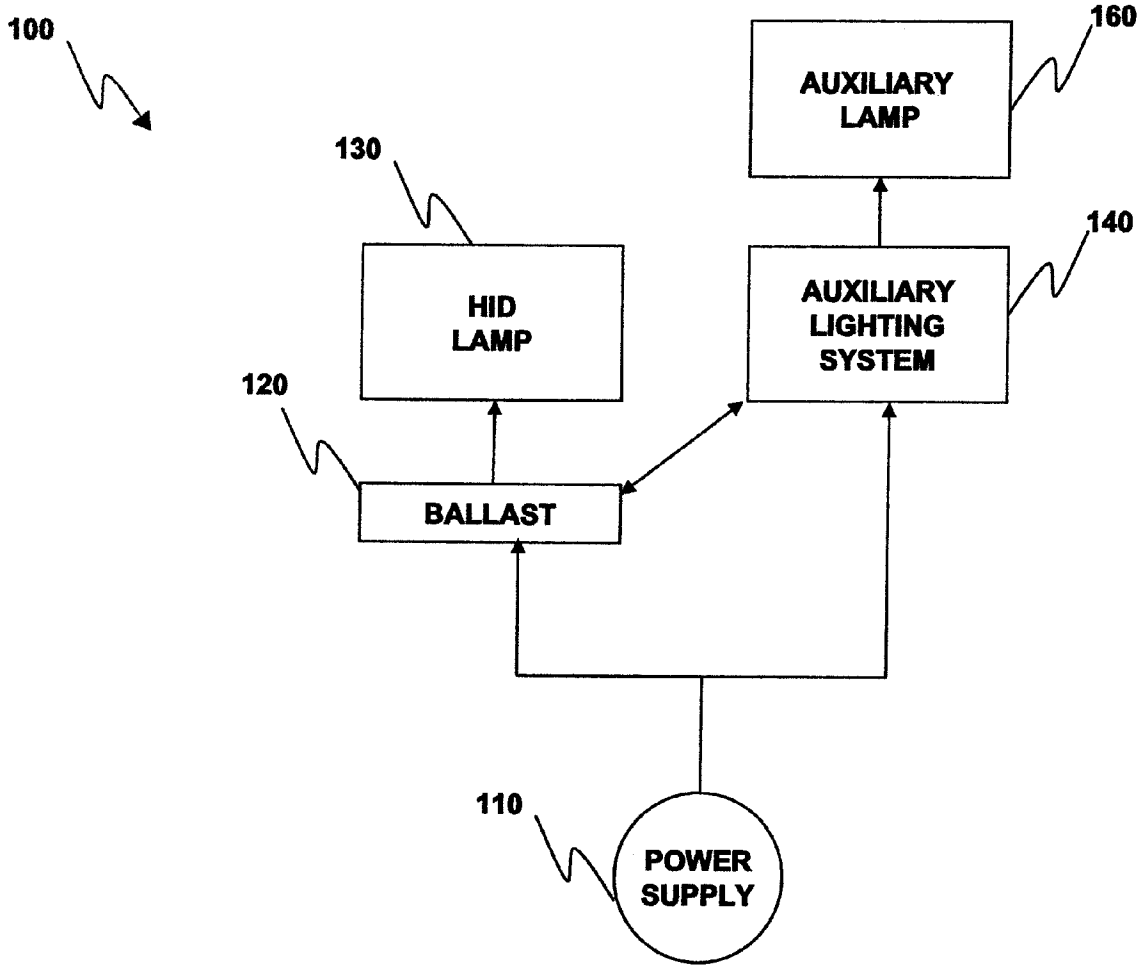
FIG. 1 is a block diagram illustration of the auxiliary lighting system employed with an HID lamp in accordance with an exemplary embodiment.

FIG. 1 is a block diagram 100 that illustrates a power supply 110 coupled with a ballast 120 to provide power to a high intensity discharge (HID) lamp 130. The ballast 120 interfaces to an auxiliary lighting system 140 which in turn allows power to be transmitted from a power supply 110 to an auxiliary lamp 160. Power supply 110 can provide a wide range of input voltages, such as 208V, 240V or 277V, for example. Additionally, voltage and/or current provided by the power supply 110 can have any number of characteristics. For example, in one embodiment the power can have alternating current with a frequency of 60 Hz. Of course the present concepts may be implemented with lighting systems utilizing alternating current of other frequencies.

The ballast 120 can receive power from the power supply 110 to provide an initial voltage to the HID lamp 130. The ballast 120 can start the HID lamp 130 by causing an arc to form inside the lamp. Once the lamp is lit, the current flowing through the lamp is regulated to keep the arc operating at peak efficiency. It is to be appreciated that the ballast 120 can be "matched" to provide appropriate power to the HID lamp 130.

The HID lamp 130 can be a mercury vapor, a metal halide, a high-pressure sodium or a low-pressure sodium lamp, for example. The efficiency of the HID lamp 130 can vary widely based on the type of lamp employed. For example, mercury vapor has a low efficiency whereas low-pressure sodium is among the most efficient light sources. In addition, color rendering can vary based on the type of lamp employed. For example, a mercury vapor lamp can provide a bluish light whereas low-pressure sodium can provide yellow light.

The auxiliary lighting system 140 is employed to turn on the auxiliary lamp 160 when the HID lamp 130 goes into a hot re-strike condition or is too dim to provide adequate light during a warm-up condition which can occur if the power supply 110 has experienced an interruption. In this manner, the system 100 can provide auxiliary light throughout a particular lighting system that amounts to a fraction (e.g., one percent) of the total lumens emitted. The auxiliary lamp 160 can remain on until the HID lamp 130 reaches a predetermined power level. During this time, the ballast 120 may be in hot re-strike mode such that the HID lamp 130 cannot be reignited because the starter voltage is not sufficient to restart the HID lamp 130 under high pressure. As the HID lamp 130 cools down and pressure drops, sufficient power can be applied and the HID lamp 130 can be restarted again. For example, the auxiliary lighting system 140 (and auxiliary lamp 160) can stay on until the power applied to the HID lamp 130 reaches 200 watts. After reaching such predetermined power level, the auxiliary lighting system 140 and auxiliary lamp 160 turn off.

In accordance with the illustrated embodiment, the auxiliary lighting system will continue to operate even if the ballast 120 fails. In this maimer, the ballast 120 and the auxiliary lighting system 140 interface to a common power supply 110 though disparate connections. Thus, if a fuse in the ballast 120 fails, the HID lamp 130 will turn off while the auxiliary lighting system 140 will continue to operate.

Figure 2:
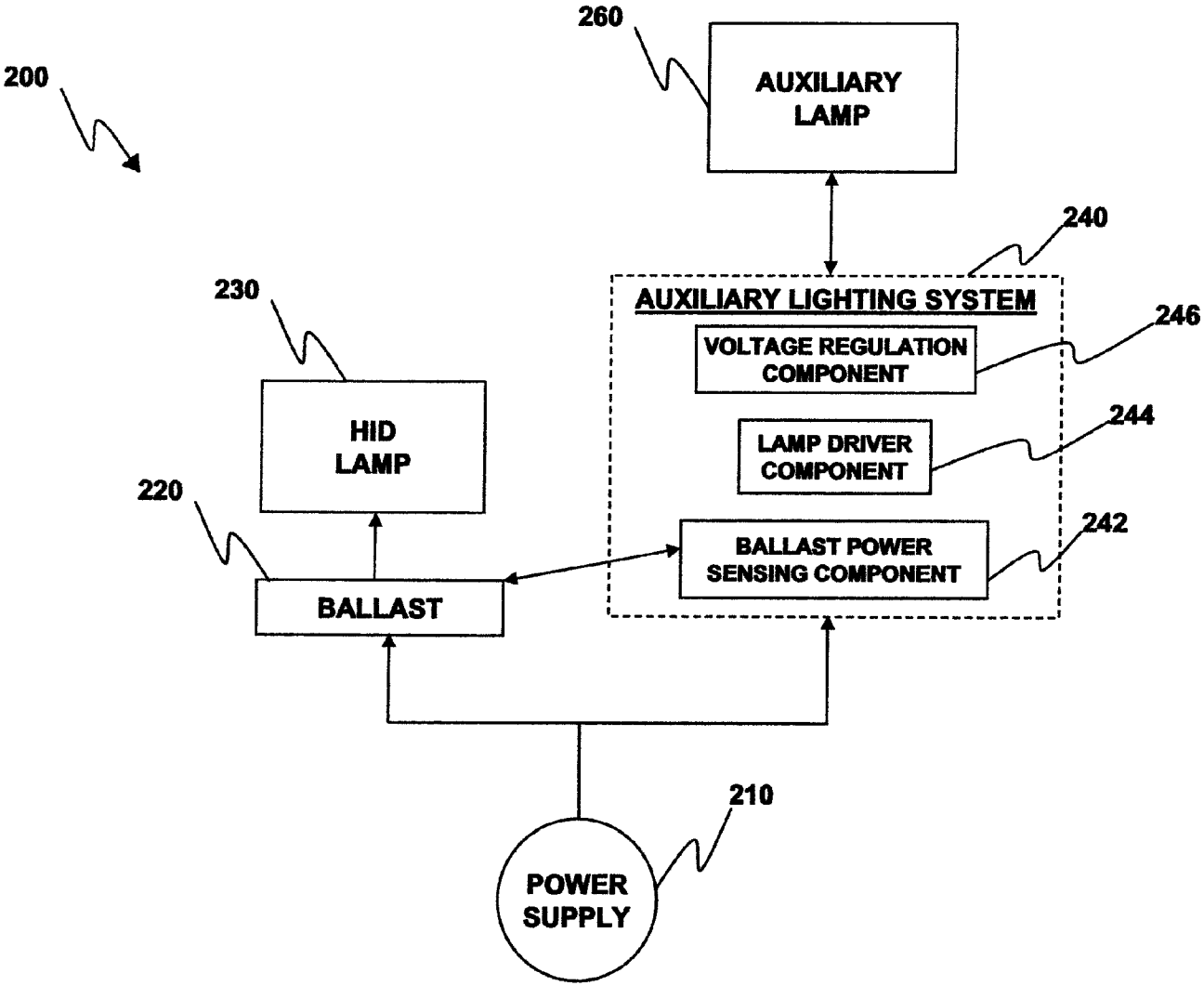
FIG. 2 is a block diagram that illustrates a detail of the auxiliary lighting system in accordance with an exemplary embodiment.

FIG. 2 is a block diagram 200 of an embodiment wherein a power supply 210 is connected to a ballast 220 to provide power to an HID lamp 230. An auxiliary lighting system 240 interfaces to the same power supply 210 to provide power to an auxiliary lamp 260. The HID ballast 220 and the auxiliary lighting system 240 are coupled such that the HID ballast 220 can provide a signal to trigger the auxiliary lighting system to turn on or off as appropriate. For example, the HID lamp 230 is turned off thereby drawing less current from the auxiliary lighting system 240. Such drop in current draw is detected to activate the auxiliary lighting system 240 which provides power to the auxiliary lamp 260.

A ballast power sensing component 242 detects when power delivered to the ballast 220 is below a predetermined level. Such a determination is made via a transformer winding coupled to the ballast 120. The ballast power sensing component can trigger a lamp driver component 244 that regulates the power delivered from the power supply 250 to the auxiliary lamp 260. For example, the lamp driver component 244 reduces the voltage from the power supply 250 from approximately 240V to 120V to deliver to the auxiliary lamp 260. It is to be appreciated that the lamp driver component accepts substantially any power level for conversion to a disparate power level. A voltage regulation component 246 maintains voltage delivered to the auxiliary lamp 260 independent of variation in the line voltage provided by power supply 250. For example, the power output to the auxiliary lamp 260 can be regulated at approximately 120V even though the input line voltage varies from 208V-277V. The auxiliary lamp 260 can be substantially any lamp that illuminates after receiving power. In one embodiment, the auxiliary lamp 260 is a 250 watt lamp that illuminates after receiving 120V.

Figure 3:
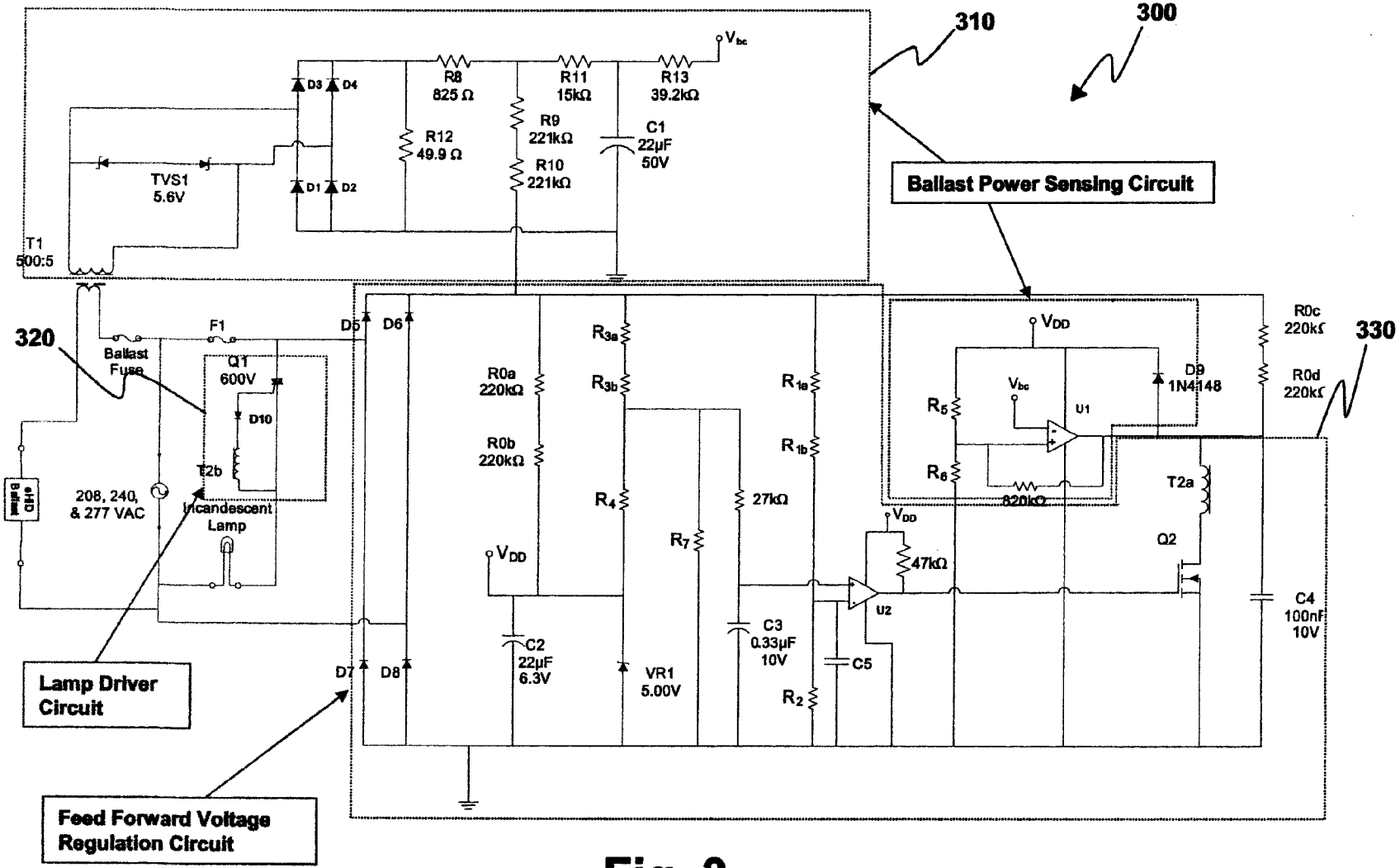
FIG. 3 is a circuit diagram of the auxiliary lighting system in accordance with an exemplary embodiment.

FIG. 3 is a circuit level diagram of an auxiliary lighting system 300 that includes a ballast power sensing circuit 310, a lamp driver circuit 320 and a feed forward voltage regulation circuit 330. As noted above, the auxiliary lighting system 300 determines when an appropriate, regulated amount of power is to be delivered to an auxiliary lamp.

The ballast power sensing circuit 310 includes current transformers T1 and TVS1; Schottky diodes D1, D2, D3 and D4; resistors R8, R9, R10, R11, R12 and R13; comparator U1; clamping diode D9; resistors R5 and R6; and capacitor C1. Voltage $V_{bc}$, developed at the output of the ballast power sensing circuit 310 is approximately a linear representation of HID ballast power. The current drawn by the HID ballast is transformed by transformer T1, rectified by the Schottky diode bridge D1-D4, and converted to a voltage in burden resistor R12. The resulting voltage is converted to a scaled current through resistor R8. The average current in the resistor pair R9 & R10 is proportional to the prevailing line voltage applied to the HID ballast input. When the current through R8 and the current through R9 & R10 are summed, a pseudo-power signal is developed, and the average value is provided by the filter R11 and C1.

Figure 4:
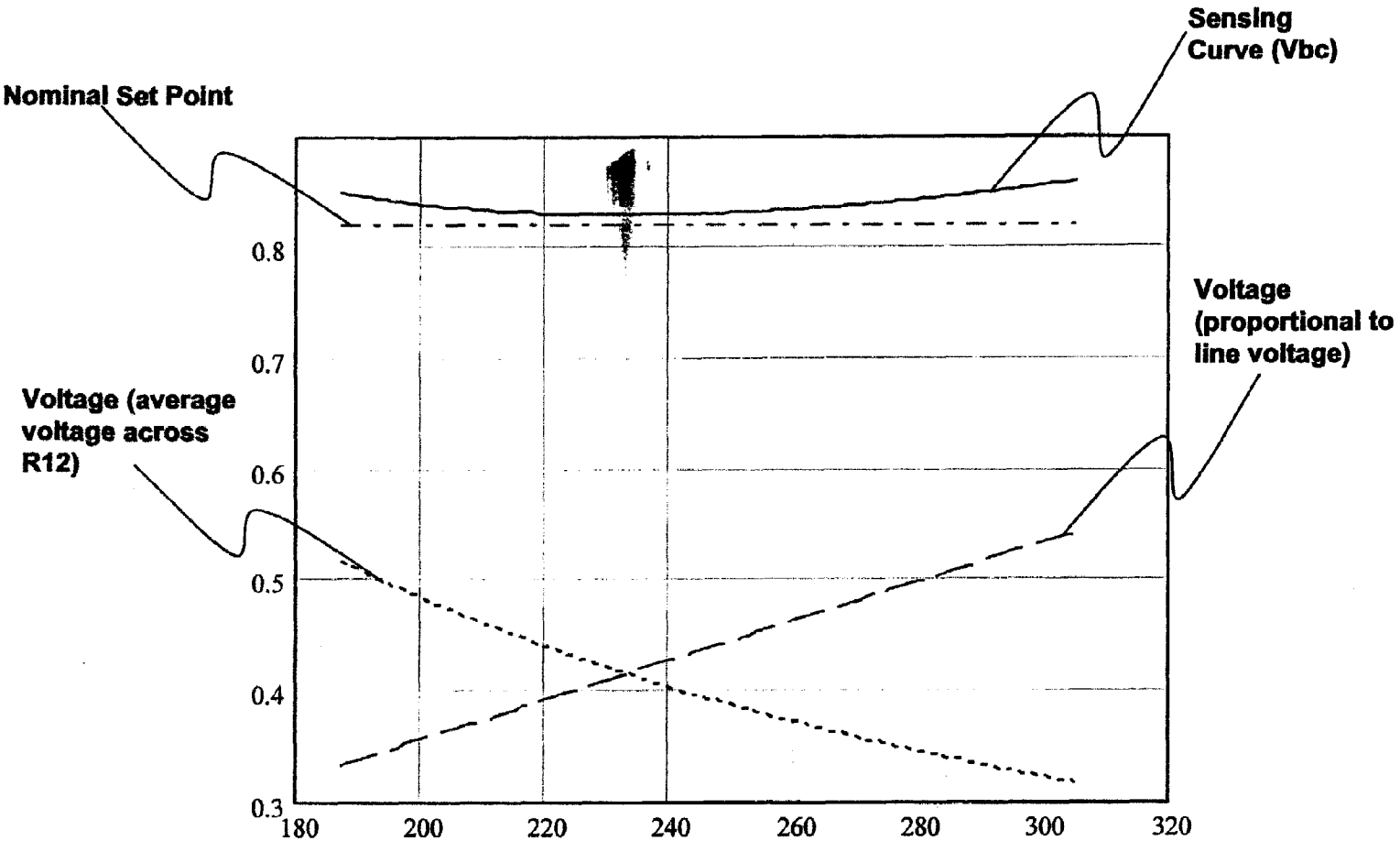
FIG. 4 is a graphical illustration of line voltage compensation related to the auxiliary lighting circuit in accordance with an exemplary embodiment.

When the voltage, $V_{bc}$, rises above a predefined threshold (determined by resistors R5 and R6), then the trigger signal applied to the triac in lamp driver circuit 320 is suppressed (through comparator U1) thereby pulling the discharge capacitor C4 low. This disables the auxiliary light circuit from operating whenever the ballast is drawing a certain prescribed amount of power. This occurs, essentially, when the HID ballast power is greater than the desired preset value. The auxiliary incandescent lamp will then be off. The relationship between the HID Ballast power and the two current signals is illustrated in FIG. 4 below.

During those times when voltage $V_{bc}$ falls below the preset voltage value set by R5 and R6, the lamp trigger signal will not be suppressed. The triac will be fired according to the timing determined by the feed forward voltage regulation circuit 330 and the incandescent lamp will be on. Since the voltage drop across the triac is relatively small, the input/output relationship is relatively independent of the power rating of the incandescent lamp.

The comparator U1 compares the feed-forward reference voltage to the instantaneous line voltage (scaled down by R1 and R2) and drives the switching of the triac through the pulse transformer T2. This circuit remains active anytime the HID lamp power falls below a desired value. In this way, the auxiliary light circuit 300 can provide an alternate light source during hot re-strike conditions and also during warm-up conditions when the HID lamp is lit but is still at a low power level.

The lamp driver circuit 320 is comprised of a triac Q1 and a transformer T2. A diode D10 is employed to protect the gate of the triac Q1. In this configuration, when a pulse is received by the transformer T2, the gate of the triac Q1 is activated and it turns on for a certain amount of phase ($\alpha$) of the line voltage. The triac reduces voltage received from the line voltage and delivered to the incandescent (auxiliary) lamp. In this manner, the incandescent lamp can operate regardless of the line voltage.

The theory of operation of the triac phasing is based on the relationship of the phase angle $\alpha$ of the triac Q1, and the RMS line voltage ($V_{Line}$) to RMS load voltage ($V_{Load}$) experienced by the incandescent lamp. This expression is given below:

$$V_{Load} = \sqrt{\frac{V_{Line}^2}{\pi}\left(\pi + \frac{1}{2}\cdot\sin(2\cdot\alpha) - \alpha\right)}$$

By adjusting $\alpha$ for the varying line voltages, the load (e.g., incandescent lamp) voltage is held relatively constant (e.g., 120V), independent of large line variations. This is accomplished in this circuit with the feed-forward element comprised by $R_3$, $R_4$, $R_7$, and the voltage reference VR1. This circuit produces a threshold voltage at which the triac is switched. This threshold is designed to change linearly with the line voltage.

The feed forward voltage regulator circuit 330 circuit determines the driven, RMS, incandescent lamp voltage and includes rectifying diodes D5, D6, D7 and D8; bias resistors R0*a* and R0*b*; voltage reference VR1; filter capacitors C2, C3, and C5; reference network resistors R3*a*, R3*b*, R4, and R7; line detecting resistors R1*a* and R1*b*, and R2; comparator U2; MOSFET transistor Q2; pulse transformer T2; and pulse capacitor C4. The resistor network R3*a*, R3*b*, R4, and R7 produces a scaled voltage into the input of the triggering comparator U2 that provides a DC offset and a variable component that is linear with the line voltage thereby providing a linear function of the line voltage at the negative input to the comparator U2.

The voltage divider (including resistors R1 and R2) follows the rectified line voltage. When the rectified line voltage rises above a desired critical level, the comparator U2 goes to a low state, turning off the MOSFET transistor Q2 and allows the capacitor C4 to charge up. When the scaled line voltage drops below the threshold of this reference, it turns the MOSFET transistor Q2 on to provide a current impulse from the discharging capacitor C4 through the pulse transformer T2. This pulses the gate of the triac Q1 and the transformer T2, thereby turning on the incandescent lamp. The incandescent lamp remains on for the remainder of the line cycle until the line voltage crosses through 0V at which time the triac Q1 turns off again. During this time, the output of the triac stays high keeping capacitor C4 shorted, until such output crosses the upper threshold again. For example, if line voltage varies from 208 volts to 277 volts, the reference voltage and hence the trigger point changes thereby changing the level at which the triac Q1 is triggered. In this manner, the line voltage is regulated to approximately 120V. Other desired voltage levels can be regulated, as desired.

Capacitor C5 prevents undesired high frequency disturbances to the line voltage common in industrial environments. The capacitor C5 acts as a low pass filter with a cutoff frequency of about 1 KHz. Employing this low pass filter prevents the auxiliary lamp from triggering at inappropriate times causing fluctuation in incandescent line voltage which can be perceived as lamp flicker or flash. For example, line voltage variation of approximately 20V can be reduced to a 3V variation before delivery to the incandescent lamp utilizing this technique.

The auxiliary lighting circuit 300 demonstrated the following values when reduced to practice:

| Line Voltage | Aux. Lamp Voltage | Input Power Threshold For Aux. Lamp Cut-Out |
|---|---|---|
| 187 V | 124.3 V | 209.4 W |
| 208 V | 117.4 V | 215.0 W |
| 240 V | 118.4 V | 215.9 W |
| 277 V | 123.4 V | 212.8 W |
| 300 V | 127.5 V | 204.9 W |

FIG. 4 is a graph of related data curves that illustrate signal voltage as related to ballast line power. The curve that represents voltage across resistor R12 represents the contribution from the current sensing circuit. For example, if the ballast power is constant at 215 W and the load (e.g., auxiliary lamp) is subjected to different line voltages, the amount of current drawn will change accordingly.

The curve that represents voltage that is proportional to line voltage illustrates how power delivered to a lighting circuit can fluctuate. Conventionally, such line voltage variation causes deleterious effects to the circuit such as improperly activating an auxiliary light and/or providing improper power to such auxiliary lights. The sum of the voltage across resistor R12 curve and voltage that is proportional to the line voltage is represented by the sensing curve line at the very top of the graph. In this manner, the circuit compensates for changes in the power line voltage by adding a power line voltage component to the sensing voltage. For example, the power line current will decrease as the power line voltage increases. Thus, the sensing curve is kept relatively constant such that it is proportional to the power that the HID ballast is drawing.

Figure 5:
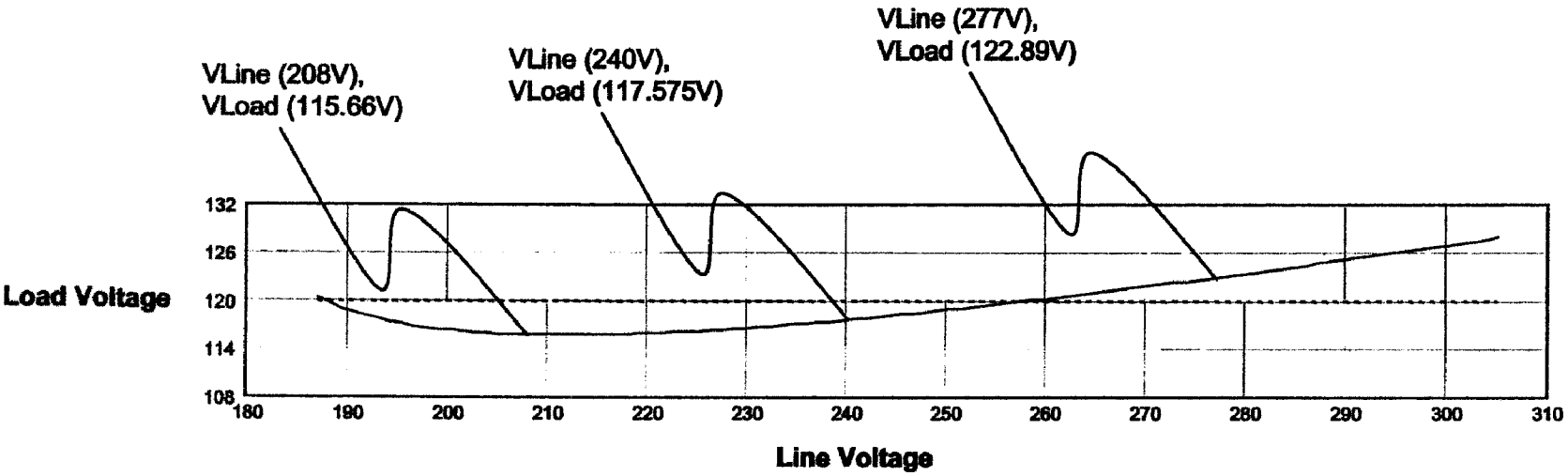
FIG. 5 is a graphical illustration of the predicted input/output relationship of the auxiliary lighting circuit in accordance with an exemplary embodiment.

The nominal set point represents the threshold value for activating the auxiliary lamp. This set point value is determined by changing resistor values in a voltage divider, for example. If the sensing curve is greater than the nominal set point, the auxiliary lamp will not be activated. In contrast, if the sensing curve is less than the nominal set point, the auxiliary lamp will be activated. In this embodiment, the sensing curve is greater than the nominal set point thereby keeping the auxiliary light in an off state FIG. 5 is a graphical illustration of the predicted input/output relationship of the auxiliary lighting circuit that charts the load (e.g., auxiliary incandescent lamp) voltage versus the line voltage of the circuit. In this embodiment, the auxiliary lamp is rated for 120V and can operate within a predetermined voltage range without noticeable fluctuation in light output. For example, if the voltage is between 115V and 125V, there may be no appreciable difference in lumens output by the incandescent lamp. The lamp driver circuit above is employed to provide a relatively constant load voltage regardless of line voltage variation. In this manner, the incandescent lamp can operate independently of the line voltage input into the auxiliary lighting system.

The circuit disclosed in FIG. 3 was built using the nominal component values shown in the illustration. It was tested on a 100 W, a 150 W, and a 250 W auxiliary incandescent lamp load. The output voltages observed across the 250 W lamp were: 124.0.VAC for a 277VAC line, 118.4VAC for a 240VAC line, and 116.0VAC for a 208VAC line.

Using a 250 W prototype HID ballast to light, warm-up, and re-light a 250 W HID lamp, the auxiliary light source illuminated the 250 W quartz halogen lamp when the HID lamp was in hot re-strike or in warm-up. The auxiliary light source then extinguished and stayed off when the HID lamp was in its normal, steady state operating state.

It is to be appreciated by one skilled in the art that the foregoing disclosure does not reference every component in the circuit level drawings contained herein. Further, it is understood that the exemplary embodiments disclosed are but one approach to practice the novel concepts set forth in this disclosure. In addition, it is to be appreciated that the figures in conjunction with the specification provide an enabling disclosure to one skilled in the art. The chart below provides values for circuit components mentioned above and/or contained in the circuit level figures:

| Reference Character | Component |
|---|---|
| C1 | Capacitor (22 uF/50 V) |
| C2 | Capacitor (22 uF/6.3 V) |
| C3 | Capacitor (0.33 uF/10 V) |
| C4 | Capacitor (100 nF/10 V) |
| C5 | Capacitor (10 nF) |
| D1 | Diode |
| D2 | Diode |
| D3 | Diode |
| D4 | Diode |
| D5 | Diode |
| D6 | Diode |
| D7 | Diode |
| D8 | Diode |
| D9 | Diode (1N4148) |
| D10 | Diode |
| F1 | Fuse (0 Ohm) |
| Q1 | Triac (600 V) |
| Q2 | MOSFET Transistor |
| R0a | Resistor (220K) |
| R0b | Resistor (220K) |
| R0c | Resistor (220K) |
| R0d | Resistor (220K) |
| R1a | Resistor (866K) |
| R1b | Resistor (866K) |
| R2 | Resistor (16.2K) |
| R3a | Resistor (866K) |
| R3b | Resistor (866K) |
| R4 | Resistor (82.5K) |
| R5 | Resistor (200K) |
| R6 | Resistor (39.2K) |
| R7 | Resistor (19.1K) |
| R8 | Resistor (825) |

-continued

| Reference Character | Component |
|---|---|
| R9 | Resistor (221K) |
| R10 | Resistor (221K) |
| R11 | Resistor (39.2K) |
| R12 | Resistor (49.9K) |
| R13 | Resistor (15K) |
| T1 | Inductor (500:5) |
| T2 | Pulse Transformer |
| TVS1 | Diode (5.6 V) |
| U1 | Comparator |
| U2 | Comparator |
| VR1 | Voltage Regulator (5.00 V) |

What is claimed is:

1. A method to activate an auxiliary light source, comprising:

sensing the presence of a current drawn by an electronic ballast;

transforming the current via an inductive winding;

rectifying the current via a diode bridge;

converting the current into a voltage via a burden resistor;

scaling the converted voltage into a first current via a resistor;

summing the first current with a second current to provide a total current, wherein the second current is proportional to a line voltage applied to the electronic ballast;

converting the total current to a total voltage; and comparing the total voltage to a reference voltage to trigger power delivery to an auxiliary lamp when the comparison meets a particular threshold.

2. The method of claim 1, further comprising converting the line voltage to an auxiliary lamp voltage to provide power to the auxiliary lamp.

3. The method of claim 2, wherein the line voltage is in a range of approximately 200-300 VAC.

4. The method of claim 2, wherein the auxiliary lamp voltage is approximately 120 VAC.

5. The method of claim 1, further comprising regulating the auxiliary lamp voltage to maintain a desired value.

6. The method of claim 5, further comprising regulating the auxiliary lamp voltage to within three volts of a particular voltage level.

7. The method of claim 6, regulating the auxiliary lamp voltage is accomplished by controlling the phase angle of switched voltage applied to the auxiliary lamp.

8. The method of claim 1, further comprising filtering the total voltage to eliminate high frequency disturbances before comparison to the reference voltage.

* * * * *